United States Patent [19]

Wiehe et al.

[11] Patent Number: 4,563,384

[45] Date of Patent: Jan. 7, 1986

[54] ELASTIC FLAT-SURFACED WOVEN FABRIC AND ITS MANUFACTURE

[75] Inventors: Hans R. Wiehe; Herbert Hueber, both of Dormagen, Fed. Rep. of Germany

[73] Assignee: Bayer Aktiengesellschaft, Leverkusen, Fed. Rep. of Germany

[21] Appl. No.: 606,481

[22] Filed: May 3, 1984

[30] Foreign Application Priority Data

May 4, 1983 [DE] Fed. Rep. of Germany ..... 3316266

[51] Int. Cl.[4] ..... D03D 15/08

[52] U.S. Cl. ..... 428/231; 139/421

[58] Field of Search ..... 428/231; 139/421

[56] References Cited

U.S. PATENT DOCUMENTS 3,199,548 8/1965 Conant ..... 428/231 X

*Primary Examiner*—Alexander S. Thomas

*Attorney, Agent, or Firm*—Sprung Horn Kramer & Woods

[57] ABSTRACT

An elastic flat-surfaced fabric with improved recovery properties, in particular after washing, may be obtained from spinning fibre yarns containing elasthan filament yarn if 30 to 70% by weight of the spinning fibres in the spinning fibre yarns containing elasthan filament yarn are synthetic fibres.

5 Claims, No Drawings

ELASTIC FLAT-SURFACED WOVEN FABRIC AND ITS MANUFACTURE

This invention relates to an elastic, flat-surfaced fabric with improved recovery properties, in particular after washing, woven from spinning fibre yarns containing elasthan filaments.

Flat-surfaced woven fabrics which are elastic in the longitudinal or transverse direction or in both directions are known for the manufacture of garments. These fabrics may consist of elastic yarns in both the warp and weft direction or of inelastic yarns in one direction and elastic yarns in the other, the elastic yarns consisting of elasthan filaments covered with cellulose spinning fibres which are either spun, twisted or wound round the elasthan filaments while the inelastic yarns are pure cellulose fibre yarns. Depending upon the fabric construction and elasthan content, such fabrics normally have a stretchability of from 20 to 35% and a residual elongation (permanent elongation) of from 4 to 8% after they have been dyed and finished. If these fabrics are subjected to repeated washing followed by tumble drying, the residual elongation (tested dynamically by the fatigue test) rises to 10 to 14%. Since residual elongations higher than 6% seriously impair the wearing quality of garments produced from such elastic fabrics, causing sagging and stretching, the possibilities of using such fabrics are very limited.

It was an object of the present invention to provide an elastic flat-surfaced woven fabric having only a low residual elongation which is not increased by washing.

It has surprisingly been found that such a fabric may be produced if the elastic yarn used is an elasthan yarn covered with a spinning fibre yarn containing from 30 to 70% by weight, preferably at least 50% by weight, of synthetic fibres and from 70 to 30% by weight, preferably not more than 50% by weight, of cellulose fibres.

The present invention therefore provides an elastic flat-surfaced woven fabric having a stretchability of from 20 to 35% and containing elastic spinning fibre yarns with a proportion of from 3 to 15% by weight of elasthan filament yarn, based on the total weight of the elastic spinning yarn, characterized in that from 30 to 70% by weight of the spinning fibres of the elastic spinning fibre yarns consist of synthetic fibres and from 70 to 30% by weight of said spinning fibres consist of cellulose fibres.

The elastic flat-surfaced fabric according to the invention may be transversely elastic with elastic weft yarn and inelastic warp yarn, longitudinally elastic with elastic warp yarn and inelastic weft yarn, or bidirectionally elastic with elastic weft and warp yarn.

The inelastic spinning fibre yarn may also contain 30 to 70% by weight of synthetic fibres but preferably consists of pure cellulose fibres. The synthetic fibres to be considered are mainly polyamide fibres and in particular polyester fibres.

The effect of preventing the increase in residual elongation normally resulting from washing may be reinforced by subjecting the finished fabric to a resin treatment.

The resins particularly suitable for this purpose are those recommended for crease-resistant finishes. Such resins are well known to the skilled person.

The flat-surfaced fabric may have different types of weaves, such as linen weave, satin weave or twill weave. The term "flat-surfaced fabric" is used to distinguish it from "pile fabrics" (see Béla von Falkai, Synthesefasern, Verlag Chemie, Weinheim Deerfield Beach, Fla.-Basle 1981, ISBN 3-527-25824-8, Pages 342 to 344).

The flat-surfaced fabrics according to this invention are produced by known weaving techniques, using elastic spinning fibre yarns either in both thread systems, i.e. warp and weft, or inelastic yarns in one system and elastic yarns in the other, depending upon the direction in which stretchability is required. The elastic spinning fibre yarn consists of elasthan filament yarn covered with spinning fibre yarn, and from 30 to 70% by weight of the spinning fibres are synthetic fibres. The inelastic yarn used may be a mixed yarn containing from 30 to 70% by weight of synthetic fibres and from 70 to 30% by weight of cellulose fibres. The fabric according to the invention may, in particular, be given a high grade finish as part of the after-treatment process (for definition, see K. Lindner, Tenside Textilhilfsmittel-Waschrohstoffe, Wissenschaftliche Verlagsgesellschaft mbH Stuttgart, 1964, pages 1646 to 1664).

In high grade finishing, resins are applied to the fabric, in particular aminoplasts, precondensates of urea/formaldehyde, melamine/formaldehyde or modified or etherified urea/formaldehyde or melamine/formaldehyde precondensates, and in particular reactive resins well known to the skilled person (Lindner, pages 245–266).

When elastic fabrics having the mixed yarn construction described above were subjected to repeated, intensive washing and tumble drying, they were found to have a residual elongation (permanent elongation) similar to that of unwashed fabric when tested by a so-called continuous oscillation fatigue test between constant limits of elongation. In this test method, a sample in the form of a strip is subjected to 100,000 stretching cycles at about $3H_z$ between two given stretching limits. The permanent elongation is measured immediately after 100,000 stretching cycles ($\epsilon_R$ immediately) and after 24 hours recovery time ($\epsilon_{R24}$).

Wearing tests also confirmed that garments manufactured from such elastic fabrics showed virtually no sagging or elongation effects.

EXAMPLE

A transversely elastic twill weave having the following construction was produced:

Warp: 83.33 tex (Nm 12/1) cotton indigo dyed 310 FD/10 cm in the finished fabric.

Weft:

elastic covering yarn of 160 dtex elasthan filament yarn wound singly round the core, with 29.4 tex×2 (2×Nm 34/1)

Mixed yarn:

50% cotton

50% polyester.

175 Fd/10 cm in the finished fabric $$\text{Weave: } \frac{3}{1} \times \text{twill}$$

$m^2$ weight: 430 g

Stretchability: 25%.

This tranversely elastic unfinished denim fabric was subjected to the following finishing process:

1. desizing 60 minutes at 60° C.
2. drying on tenter frame at 160° C.
3. fixing on tenter frame at 185° C. for 90 sec.

4. high grade finishing on Foulard using a bath containing, per liter, 130 g of reactive resin based on glyoxal-monourein, 15 ml of aqueous zinc chloride solution and 2 g of urea, and squeezing off to reduce the weight increase to 80%, based on the dry weight of the fabric.
5. condensation at 160° C. for 120 secs and
6. decating.

This transversely elastic fabric (A) was then subjected to a fatigue test (continuous vibration) for comparison with a fabric (B) having the same construction but with the covering fibre consisting of pure cotton, and without the high-grade finish. Both washed and unwashed fabric was tested.

| Test conditions: | |
|---|---|
| Size of sample: | length 200 mm width 60 mm fluted to 50 mm |
| Clamped length: | 100 mm |
| Maximum elongation: | 25% |
| elongation cycles: | 100,000 |
| frequency: | about 3 Hz |
| test apparatus: | continuous flexion and tension testing machine Z445 manufactured by Zwick. |

After completion of the elongation cycles, the samples were removed from the apparatus and their residual elongation $\epsilon_{residual}$ was measured within 3 minutes with the samples lying relaxed on a surface. After a recovery time of 24±1 hours with the samples lying in a relaxed state, the second measurement was carried out by the same method to determine $\epsilon_{R24}$. The results shown are average results taken from four samples for each part of the experiment.

The following results were obtained:

| | Residual elongation | | | |
|---|---|---|---|---|
| | unwashed | | washed | |
| | $\epsilon_{residual}$ immediate | $\epsilon_{residual}$ 24 hours | $\epsilon_{residual}$ immediate | $\epsilon_{residual}$ 24 hours |
| Fabric B | 6.0% | 3.5% | 10.1% | 6.6% |
| Fabric A | 4.0% | 2.9% | 4.5% | 2.8% |

We claim:

1. An elastic flat-surfaced woven fabric having a stretchability of from 20 to 35%, comprising elastic spinning fibre yarns having a proportion of 3 to 15% by weight of elasthan filament yarn, based on the total weight of the elastic spinning fibre yarn, and spinning fibre yarn which consists essentially of 50 to 70% by weight of a fibre selected from the group consisting of polyamide and polyester fibres, and 30 to 50% by weight of cellulose fibres.

2. An elastic flat-surfaced fabric according to claim 1, wherein said fabric is in a high grade finished form.

3. An elastic flat-surfaced woven fabric according to claim 1 wherein said fibre is polyester fibres.

4. A process according to claim 3, further comprising subjecting the fabric to a high grade finishing.

5. An elastic flat-surfaced woven fabric according to claim 1 wherein said cellulose fibre is cotton.

* * * * *